United States Patent [19]

Ezoe

[11] 4,217,863

[45] Aug. 19, 1980

[54] FUEL INJECTION SYSTEM EQUIPPED WITH A FUEL INCREASE COMMAND SIGNAL GENERATOR FOR AN AUTOMOTIVE INTERNAL COMBUSTION ENGINE

[75] Inventor: Mitsuhiko Ezoe, Yokosuka, Japan

[73] Assignee: Nissan Motor Company, Limited, Yokohama, Japan

[21] Appl. No.: 945,386

[22] Filed: Sep. 25, 1978

[30] Foreign Application Priority Data

Nov. 4, 1977 [JP] Japan ..... 52/132205

[51] Int. Cl.[2] ..... F02B 3/00

[52] U.S. Cl. ..... 123/494; 123/492; 123/493

[58] Field of Search ..... 123/32 EJ, 32 EH, 32 EA, 123/119 EC

[56] References Cited

U.S. PATENT DOCUMENTS

| | | | |
|---|---|---|---|
| 3,727,591 | 4/1973 | Sindes | 123/32 EH |
| 3,880,125 | 4/1975 | Kammener et al. | 123/32 EJ |
| 3,882,829 | 5/1975 | Sasaki | 123/32 EA |
| 3,898,963 | 8/1975 | Iwata et al. | 123/32 EH |
| 4,010,717 | 3/1977 | Taplin | 123/32 EH |
| 4,051,818 | 10/1977 | Völckers | 123/32 EJ |
| 4,121,545 | 10/1978 | Mizute | 123/32 EJ |
| 4,126,107 | 11/1978 | Haradar et al. | 123/32 EH |
| 4,127,086 | 11/1978 | Harada et al. | 123/32 EL |
| 4,138,979 | 2/1979 | Taplin | 123/119 EC |
| 4,144,847 | 3/1979 | Hasaka | 123/32 EE |

*Primary Examiner*—Charles J. Myhre
*Assistant Examiner*—Raymond A. Nelli
*Attorney, Agent, or Firm*—Schwartz, Jeffery, Schwaab, Mack, Blumenthal & Koch

[57] ABSTRACT

A fuel injection system equipped with a fuel increase command signal generator for an automotive internal combustion engine, comprising an airflow meter for measuring the airflow rate of the intake air for determining the pulse width of a pulse signal with which fuel injection valves are energized; and a fuel increase command signal generator for producing a command signal with which the fuel flow rate is momentarily increased. The fuel increase command signal generator includes a differentiator and a comparator for detecting the rate of decrease of the airflow, another comparator for detecting the opening degree of the throttle valve of the engine, and an AND gate for producing the fuel increase command signal so that the fuel flow rate is increased only when the rate of decrease of the airflow is over a predetermined value while the throttle valve is closed or nearly closed.

7 Claims, 9 Drawing Figures

FUEL INJECTION SYSTEM EQUIPPED WITH A FUEL INCREASE COMMAND SIGNAL GENERATOR FOR AN AUTOMOTIVE INTERNAL COMBUSTION ENGINE

FIELD OF THE INVENTION

This invention generally relates to a fuel injection system for an internal combustion engine of an automotive vehicle. More specifically, the present invention relates to such a system with circuitry for producing a signal with which fuel flow rate is increased for compensating for leaning of the air/fuel mixture due to an erroneous signal indicative of an airflow rate induced by the overshoot characteristics of the airflow meter.

BACKGROUND OF THE INVENTION

In a fuel injection system for an internal combustion engine, the fuel flow rate is determined basically in accordance with the rate of airflow inducted into the cylinders of the engine and the rotational speed (rpm) of the engine. The rate of airflow is controlled by a throttle valve disposed in the intake passage of the engine where the opening degree of the throttle valve is controlled by an accelerator pedal which is operatively connected thereto.

An airflow meter is usually employed for measuring the airflow rate and consists of a rotatable or pivotal flap disposed in the intake passageway where the flap is mechanically connected to a movable contact of a potentiometer. The flap is arranged to rotate against the biasing force of a spring under the influence of the pressure difference on the upstream side of the flap and the downstream side of same. The potentiometer is arranged to produce an output signal the voltage of which is indicative of the angular displacement of the flap and which is utilized for control of the pulse width of a pulse signal with which fuel injection valves are energized.

In such an air flow meter, a damper or a damping device is employed for reducing the flactuation of the movement of the flap. However, when the air flow rate increases or decreases abruptly, the movement of the flap is apt to be excessive to produce an overshoot phenomena and thus the potentiometer connected thereto produces an output signal indicative of an air flow rate which is higher or lower than the actual airflow rate. This erroneous signal causes the fuel injection system to supply more or less fuel respectively than necessary so that the air-fuel mixture becomes richer or leaner than a predetermined or desired value. Although a closed loop type air/fuel ratio control system is basically advantageous for avoiding undesirable variations of the air/fuel ratio, the closed loop system is easily influenced by such an erroneous signal since a time delay is inherent in the system. The undesirably enriched or impoverished air-fuel mixture causes an increase of the concentration of toxic components in the exhaust gases and also a decrease in the efficiency of a catalytic converter (if a three-way type), if disposed, in the exhaust system since such a catalytic converter exhibits its maximum efficiency when the air/fuel ratio of the air-fuel mixture is maintained within a narrow range (usually close to the stoichiometric value).

The above mentioned undesirable overshoot characteristics of the flap of the airflow meter can be reduced to a negligible extent by designing and adjusting the damper or the damping device carefully and precisely.

However, such an airflow meter requires a complex construction and time consuming adjustment of the same. Therefore, the above mentioned provision of a complex damper for the reduction of the overshoot characteristics causes an increase in the cost of the air flow meter.

Although it is described hereinabove that overshoot phenomenon of the flap of the airflow meter occurs in case of abrupt increase and decrease of the airflow rate, the frequency of the abrupt decreases is considerably higher than that of the abrupt increases. When the airflow rate decreases abruptly the fuel flow rate decreases. However, because of the overshoot characteristics of the flap of the airflow meter, the fuel flow rate falls below a required level so that a lean air/fuel mixture is supplied to the cylinders of the engine as mentioned hereinbefore. When the air/fuel ratio is lower than a predetermined value, the air/fuel mixture is apt to misfire or improperly ignite and thus the amount of unburnt gases emitted from the engine increases.

In a conventional fuel injection system, such as described in Japanese Patent pre-publications No. 52-18535 and No. 52-25932, the fuel flow rate is increased for a predetermined period of time when the throttle valve is fully or almost closed in the former or when the rate of decrease of the airflow is over a predetermined value in the latter. With this arrangement the lean mixture due to the overshoot characteristics of the flap of the airflow meter is compensated for. However, in the former case since the fuel flow rate is increased whenever the throttle valve is fully closed, the air/fuel ratio becomes higher than a desired level when the airflow rate decreases relatively gradually. In the latter case, since the fuel flow rate is increased whenever the rate of decrease of the airflow is over a predetermined value, the air/fuel ratio becomes higher than a desired level when the airflow rate increases after an abrupt decrease of the same. This means that in the conventional fuel injection system with a circuit which provides an increase of fuel flow rate for compensating for the air/fuel ratio, the fuel flow rate is increased not only in case it is necessary but also when it is unnecessary. Since the additional fuel is supplied to the engine undesirably, in case it is unnecessary, engine operation tends to be unstable and further fuel cost increases.

SUMMARY OF THE INVENTION

The present invention has been developed in order to remove the above mentioned drawbacks of the fuel injection system. According to the present invention, there is provided a fuel injection system equipped with circuitry which produces a fuel increase command signal with which the fuel flow rate through the injection valves is momentarily increased. The circuitry is arranged to produce the fuel increase command signal for a short period of time only when the throttle valve of the engine is fully or almost closed and the rate of decrease of the airflow is over a predetermined value.

It is therefore, an object of the present invention to provide an improved fuel injection system equipped with circuitry which produces a fuel increase command signal by which the engine operation is maintained stable.

Another object of the present invention is to provide such a system in which fuel consumption is lower than that of the conventional system.

Further object of the present invention is to provide such a system in which emission of unburnt gases due to an air/flow mixture richer than a desired value is reduced.

Still further object of the present invention is to provide such a system in which misfire and improper ignition are prevented.

Yet further object of the present invention is to provide such a system in which shocks due to abrupt variation of the engine torque is prevented by avoiding sudden leaning of the air/fuel mixture fed to the engine.

BRIEF DESCRIPTION OF THE DRAWINGS

These and other objects and features of the present invention will be more readily apparent from the following detailed description of the preferred embodiments taken in conjunction with the accompanying drawings in which.

DETAILED DESCRIPTION OF THE PREFERRED EMBODIMENT

Figure 1:
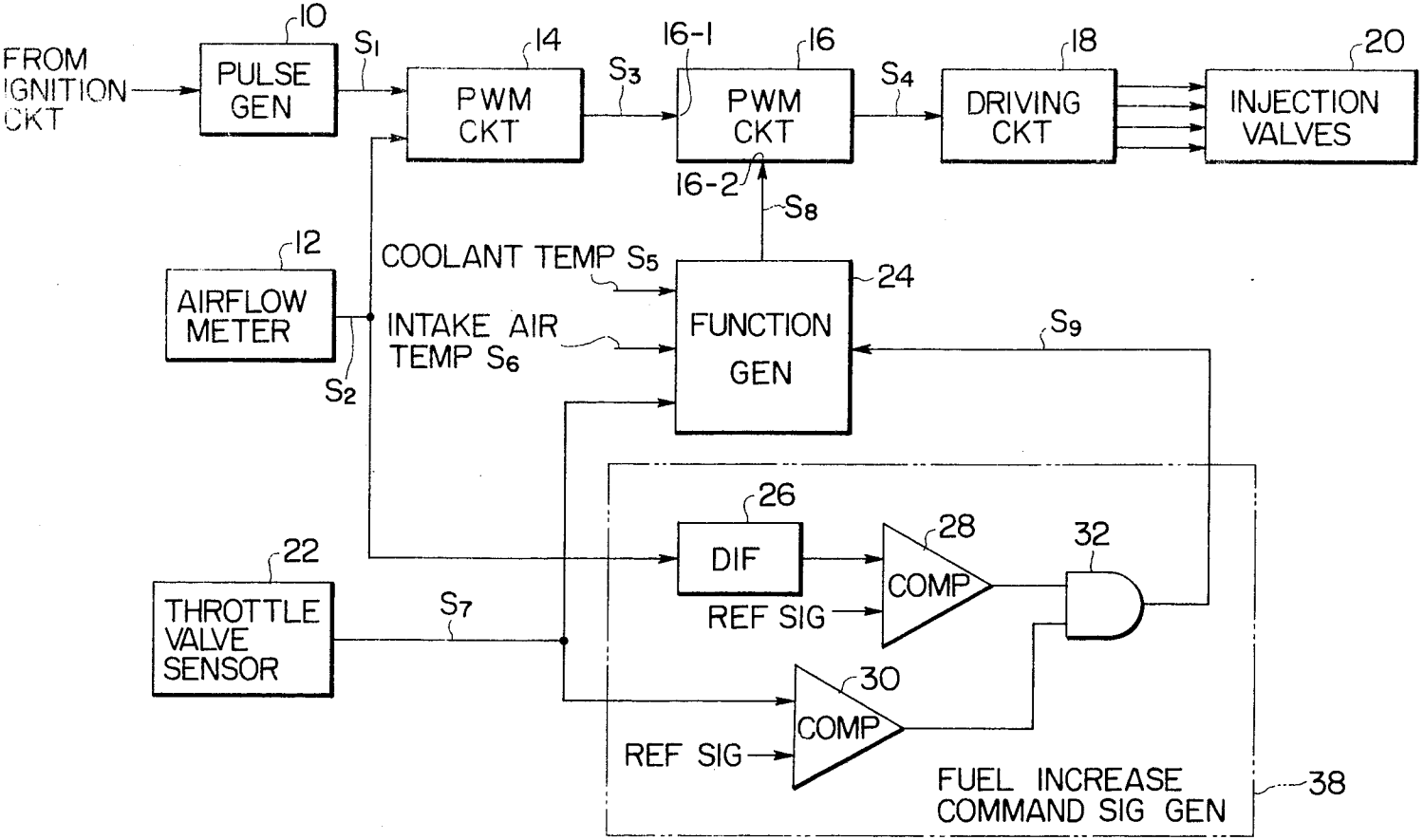
FIG. 1 shows a block diagram of a first preferred embodiment of the fuel injection system according to the present invention.

FIG. 1 illustrates in a block diagram form a first preferred embodiment of the fuel injection system equipped with circuitry for producing a fuel increase command signal. The circuit arrangement shown in FIG. 1 includes a pulse generator 10, an airflow meter 12, a first pulse width (PWM) modulation circuit 14, a second pulse width modulation circuit 16, a driving circuit 18, fuel injection valves 20, a throttle valve sensor 22, a function generator 24, and a fuel increase command signal generator 38.

Figure 2:
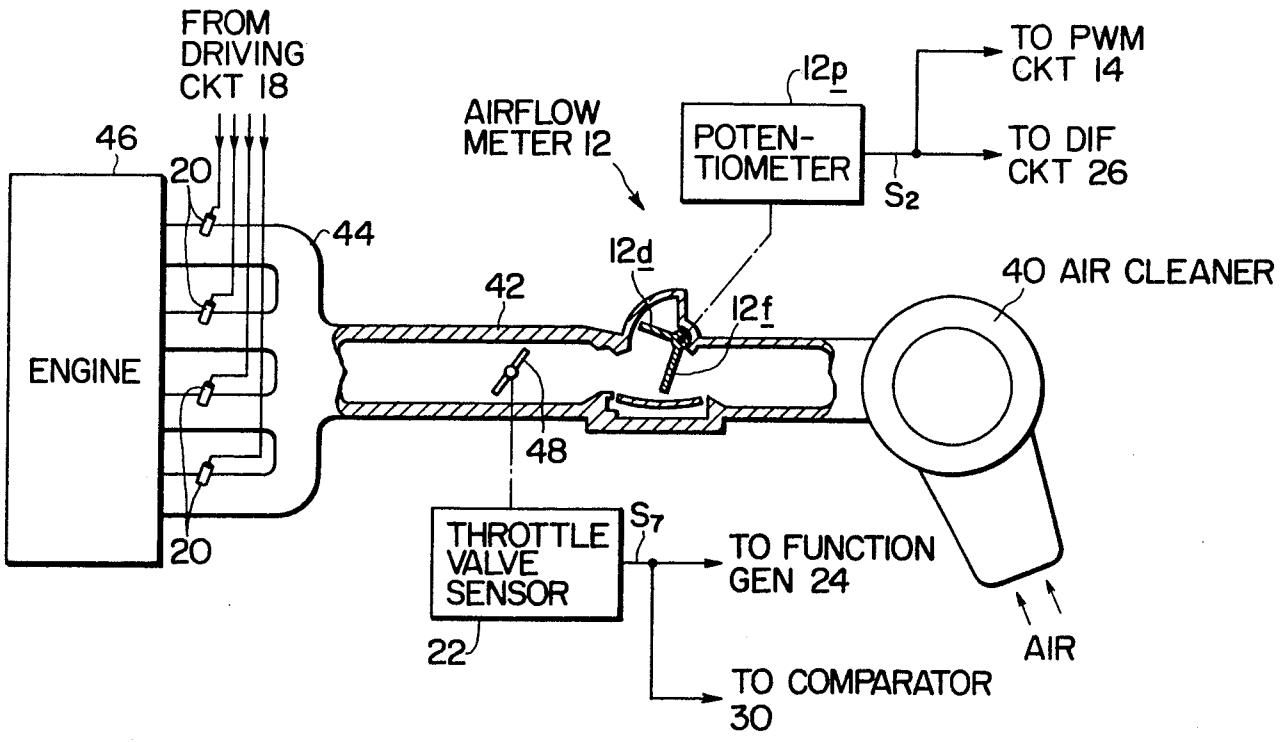
FIG. 2 shows a schematic view of the intake passage portion of an internal combustion engine with the fuel injection system shown in FIG. 1.

FIG. 2 illustrates a schematic view of the intake passage portion of an internal combustion engine with the fuel injection system shown in FIG. 1. The intake passage portion of the engine 46 includes an air cleaner 40, an intake conduit 42, the airflow meter 12, a throttle valve 48, the throttle valve sensor 22, and intake manifold 44. The intake conduit 42 is interposed between the air cleaner 40 and the intake manifold 44. The airflow meter 12 has a rotatable or pivotal flap **12*f* disposed in the intake conduit 42. A damper 12*d* is fixedly connected to the flap 12*f* for reducing overshoot or undershoot characteristics of the flap 12*f*. The airflow meter 12 further includes a potentiometer 12*p* the movable contact of which is operatively connected to the shaft of the flap 12*f*. The output of the potentiometer indicates the angular displacement of the flap 12*f* so that the rate of the airflow is represented by the same. The output signal of the potentiometer 12*p* is fed to the first pulse width modulation circuit 14 and to a differentiator 26 included in the fuel increase command signal generator 38 both shown in FIG. 1**.

The throttle valve 48 is disposed in the intake conduit 42 downstream of the airflow meter 12. The throttle valve 48 is operatively connected to an accelerator pedal (not shown) so as to be controlled thereby. The shaft of the throttle vale 48 is operatively connected to the throttle valve sensor 22 the output of which is connected to the function generator 24 and a comparator 30 included in the fuel increase command signal generator 38. The detailed arrangement of the throttle valve sensor 22 will be described hereinlater.

A plurality of fuel injection valves 20 are disposed in each branch of the intake manifold 44 so as to inject fuel into corresponding cylinders of the engine 46.

Turning back to FIG. 1 the output signal indicative of the airflow rate is designated by a reference $S_2$. The pulse generator 10 is responsive to the ignition pulses derived from the ignition circuit such as the distributor (not shown) of the engine 46. The pulse generator 10, in fact, includes a divider which divides a number of pulses produced in response to the ignition impulses by a predetermined number. For instance, if the engine is of a 4-cycle and 4-cylinder type, the number of pulses produced in response to the ignition impulses is divided by two so that the number of pulses becomes one half of the ignition impulses. The pulse width of the pulses produced by the pulse generator 10 is predetermined and is constant. The pulse signal produced by the pulse generator 10 is designated by a reference $S_1$.

The outputs of the airflow meter 12 and the pulse generator 10 are respectively connected to first and second inputs of the first pulse width modulation circuit 14. The first pulse width modulation circuit 14 produces an output pulse signal $S_3$ by modifying the pulse width of the pulse signal $S_1$ in accordance with the magnitude of the signal $S_2$ which is indicative of the airflow rate. The output of the first pulse width modulation circuit 14 is connected to a first input 16-1 of the second pulse width modulation circuit 16. The second pulse width modulation circuit 16 produces an output pulse signal $S_4$ by modifying the pulse width of the pulse signal $S_3$ in accordance with the magnitude of a correction signal $S_8$ applied to the second input 16-2 thereof. The correction signal $S_8$ is produced in the function generator 22 in accordance with various engine parameters such as engine temperature indicated by a coolant temperature $S_5$, an intake air temperature $S_5$ and throttle valve opening degree $S_7$, and a fuel increase command signal $S_9$ produced in the fuel increase command signal generator 38.

The output pulse signal $S_4$ produced by the second pulse width modulator 16 is then fed to the driving circuit 18 which produces a plurality of injection valve energizing signals. The number of the energizing signals corresponds to the number of the injection valves 20 which usually corresponds to the number of cylinders of the engine. The injection valve energizing signals are produced in turn so that each of the fuel injection valves 20 is energized to permit the transmission of fuel accordingly.

Since each of the fuel injection valves 20 is energized for a period of time corresponding to the pulse width of the pulse signal $S_4$, the fuel flow rate is controlled in accordance with the pulse width of the pulse signal $S_4$. If desired, a closed loop air/fuel ratio control circuit (not shown) may be combined with the fuel injection system for performing a feedback control in accordance with the concentration of a component contained in the exhaust gases.

The fuel increase command signal generator 38 consists of a differentiator 26, a first comparator 28, a second comparator 30, and an AND gate 32. The input of the differentiator 26 is responsive to the airflow meter output signal $S_2$ and thus produces a differentiated signal in accordance with the voltage variation of the airflow meter output signal $S_2$. In other words, the output voltage of the differentiator 26 corresponds to the rate of variation of the airflow meter output signal $S_2$. Namely, the more rapidly the flap 12*f* moves toward the closed position thereof the higher the voltage of the signal emitted from the differentiator 26.

The differentiated signal is applied to an input of the first comparator 28 the output of which is connected to a first input of the AND gate 32. The first comparator 28 is arranged to produce an output (logic "1") signal when the input voltage exceeds a predetermined reference voltage which is applied to the other input thereof. The reference voltage may be obtained by a suitable voltage divider (not shown). The input of the second comparator 30 is responsive to the output of the throttle valve sensor 22. The second comparator 30 is arranged to produce an output (logic "1") signal when the voltage applied to the input thereof is below a predetermined value. Therefore, the second comparator 30 produces an output signal when the throttle valve is fully or almost closed. The output of the second comparator 30 is connected to a second input of the AND gate 32.

With this arrangement the AND gate 32 produces a logic "1" output signal $S_9$ when both of the inputs thereof are respectively fed with a logic "1" signal. The logic "1" output signal, i.e. the fuel increase command signal $S_9$, of the AND gate 32 is then fed to the function generator 24. The function generator 24 is arranged to produce a correction signal $S_8$ in accordance with various engine parameters as mentioned hereinabove, and is further arranged to control the voltage of the correction signal $S_8$ in accordance with the fuel increase command signal $S_9$. In other words, the voltage of the correction signal $S_8$ rises by a predetermined level while the AND gate output signal assumes a logic "1" level. Since the pulse width of the pulse signal $S_4$ is controlled in accordance with the voltage of the correction signal $S_8$, the pulse width widens by a predetermined width so that the fuel flow rate increases accordingly for a short period of time which corresponds to a period of time for which the AND gate 32 output assumes a logic "1" level. It is to be noted that two conditions, viz. the fact that the rate of decrease of the airflow is over a predetermined value and the fact that the throttle valve is fully or almost closed, must be fulfiled in order to increase the fuel flow rate. Therefore, if one of the conditions is not fulfilled, the increase of the fuel flow rate is stopped.

Figure 3:
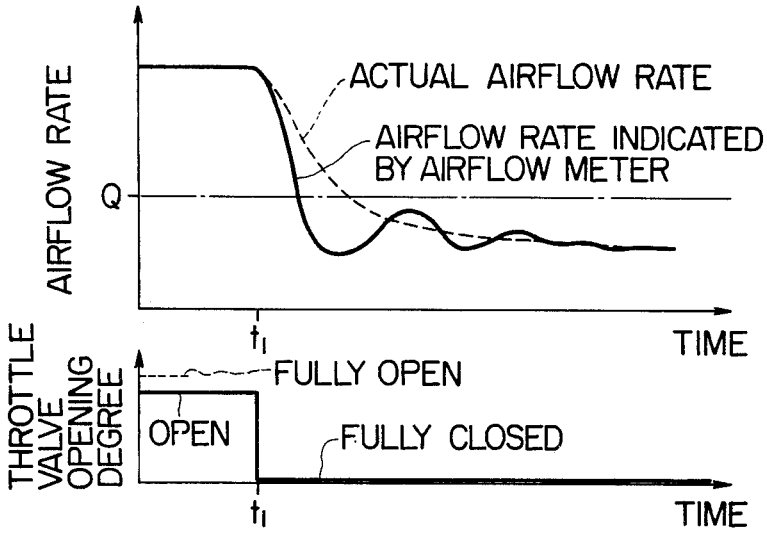
FIG. 3 to FIG. 5 respectively show in graphical form the relationship between the actual airflow rate and an airflow rate indicated by the airflow meter shown in FIG. 1 and FIG. 2 with respect to the opening degree of the throttle valve shown in FIG. 2.
Figure 4:
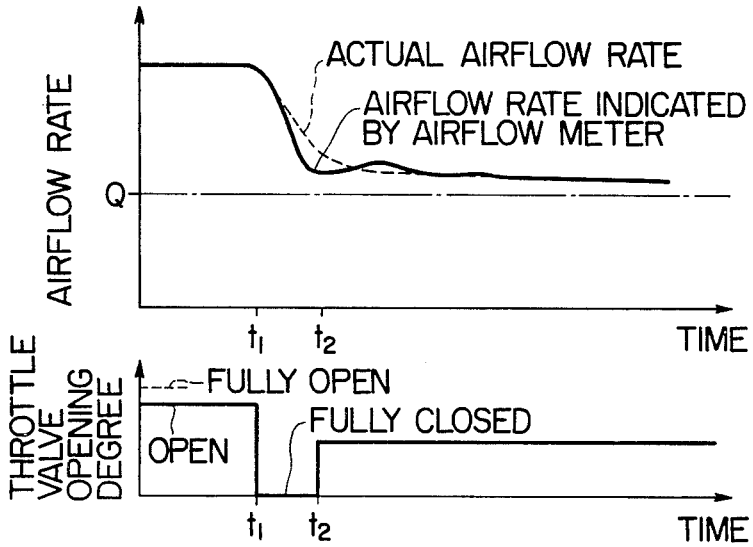
Figure 5:
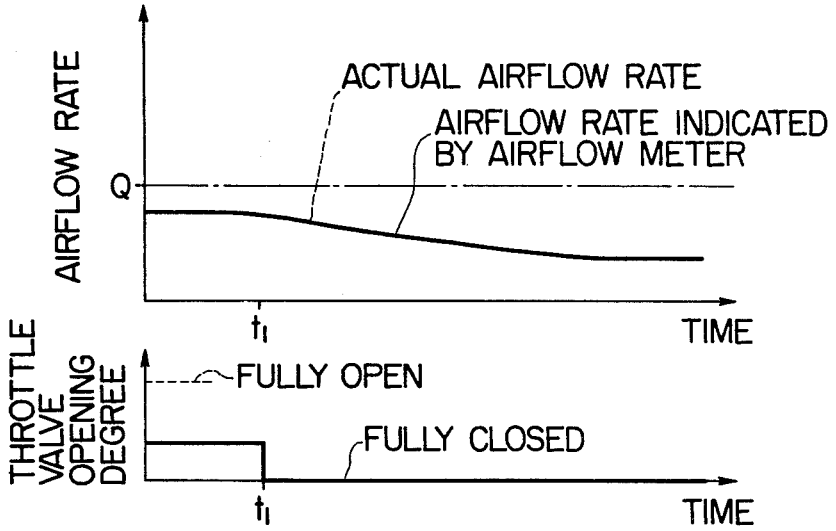

Reference is now made to FIG. 3, FIG. 4 and FIG. 5 each of which shows in a graph the relationship between the actual airflow rate and an airflow rate represented by the airflow meter 12 output signal with respect to the opening degree of the throttle valve 48. As shown in FIG. 3 when the throttle valve 48 abruptly closes from a near wide open position to its closed position at time $t_1$, the actual airflow rate decreases as indicated by a dotted line since the rotational speed of the engine 46 decreases. However, because of the overshoot characteristics of the flap 12*f* of the airflow meter 12, the output signal $S_2$ of the airflow meter 12 is prone to be erroneous. In this case, an airflow rate (shown by a solid line) indicated by the signal $S_2$ is much lower than the actual airflow rate. As time goes on, the airflow rate represented by the signal $S_2$ hunts back and forth across the actual airflow rate (since the flap 12*f* oscillates) and equals the same.

According to the present invention the fuel increase command signal $S_9$ is produced at time $t_1$ and lasts for a period of time until one of the before mentioned conditions is not fulfilled.

In FIG. 4 it is shown that the throttle valve 48 abruptly closes at time $t_1$ in the same manner as in FIG. 3 and is subsequently opened at time $t_2$ (a short period of time after time $t_1$). In this case both of the actual airflow rate and the airflow rate represented by the airflow meter 12 output signal $S_2$ decrease at almost the same rate. In this case the differentiator 26 output voltage is below the reference voltage applied to the first comparator 28 and thus the fuel increase command signal $S_9$ is not produced. Consequently, the fuel flow rate is not increased.

In FIG. 5 it is shown that the throttle valve 48 abruptly closes at time $t_1$ from a relatively low opening degree to its minimum degree. In this case the rotational speed of the engine is relatively low and thus the actual airflow rate and the airflow rate indicated by the airflow meter gradually decrease in exactly the same manner. Therefore, the output signal $S_2$ of the airflow meter 12 is not erroneous and thus there is no need to compensate for the fuel flow rate. In such a case the fuel increase command signal $S_9$ is not produced in the same manner as in the case shown in FIG. 4.

From the foregoing it will be understood that the fuel increase command signal $S_9$ is produced only in case that the airflow rate decreases at a rate over a predetermined value while the opening degree of the throttle valve 48 is zero or below a predetermined value.

Figure 6:
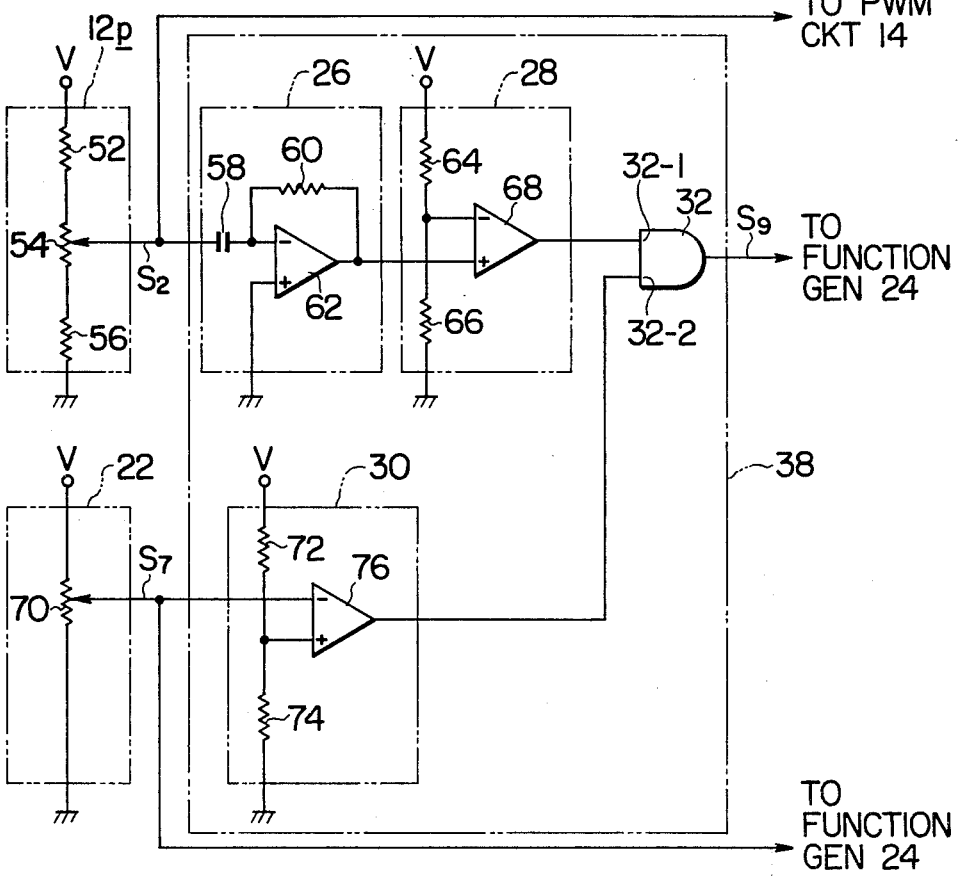
FIG. 6 shows a detailed circuit diagram of the fuel increase command signal generator shown in FIG. 1.

FIG. 6 shows a detailed circuit diagram of the potentiometer 12*p* included in the airflow meter 12, the fuel increase command signal generator 38, and the throttle valve sensor 22 shown in FIG. 1. The potentiometer 12*p* of the airflow meter 12 consists of two fixed resistors 52 and 56 and a variable resistor 54 which are connected in series and interposed between a terminal and ground. A predetermined voltage "V" is applied to the terminal. A movable contact of the variable resistor 54 is operatively connected to the shaft of the flap 12*f* shown in FIG. 2 and thus a voltage obtained at the movable contact varies in accordance with the angular displacement of the flap 12*f*. This voltage is fed to the function generator 24 shown in FIG. 1 and to an input of the differentiator 26 as the signal $S_2$. The differentiator 26 includes an operational amplifier 62, a capacitor 58, and a resistor 60. The capacitor 58 is interposed between the movable contact of the variable resistor 54 and an inverting input "−" of the operational amplifier 62, while a noninverting input "+" of the operational amplifier 62 is connected to ground. The resistor 60 is connected across the inverting input "−" of the operational amplifier 62 and the output of the same.

The first comparator 28 has two resistors 64 and 66 connected in series and an operational amplifier 68. The series circuit of the resistors 64 and 66 are interposed between a terminal to which a predetermined voltage "V" is applied and ground so as to constitute a voltage divider. A junction between the resistors 64 and 66 is connected to an inverting input of the operational amplifier 68 so that a predetermined voltage is fed thereto as a reference voltage. A noninverting input "+" of the operational amplifier 68 is connected to the output of the differentiator 26 (operational amplifier 62 output) for receiving a differentiated signal. The output of the operational amplifier 68 is connected to a first input 32-1 of the AND gate 32.

The throttle valve sensor 22 consists of a potentiometer 70 interposed between a terminal to which a predetermined voltage "V" is applied and ground. A movable contact of the potentiometer 70 is operatively connected to the shaft of the throttle valve 48 shown in FIG. 2 so that a voltage obtained at the movable contact varies in accordance with the opening degree of the throttle valve 48. The movable contact of the potentiometer 70 is connected to an inverting input "−" of an operational amplifier 76 included in the second comparator 30. A voltage divider constituted by a series circuit of two resistors 72 and 74 interposed between a terminal and ground is provided for obtaining a reference voltage which is applied to a noninverting input "+" of the operational amplifier 76. The output of the operational amplifier, i.e. the output of the second comparator 30 is connected to a second input 32-2 of the AND gate 32.

As described hereinbefore, a logic "1" signal is obtained at the output of the AND gate 32 when the first and second comparators 28 and 30 simultaneously produce logic "1" signals.

In the circuit arrangement shown in FIG. 6, the potentiometer 22 and the second comparator 30 are employed for producing a logic "1" signal indicative of the fact that the opening degree of the throttle valve 48 is below a predetermined value. However, if a switch which is arranged to close (turn on) when the opening degree of the throttle valve 48 is below a predetermined value for producing a logic "1" signal is employed, the potentiometer 70 and the second comparator 30 are not required.

Figure 7:
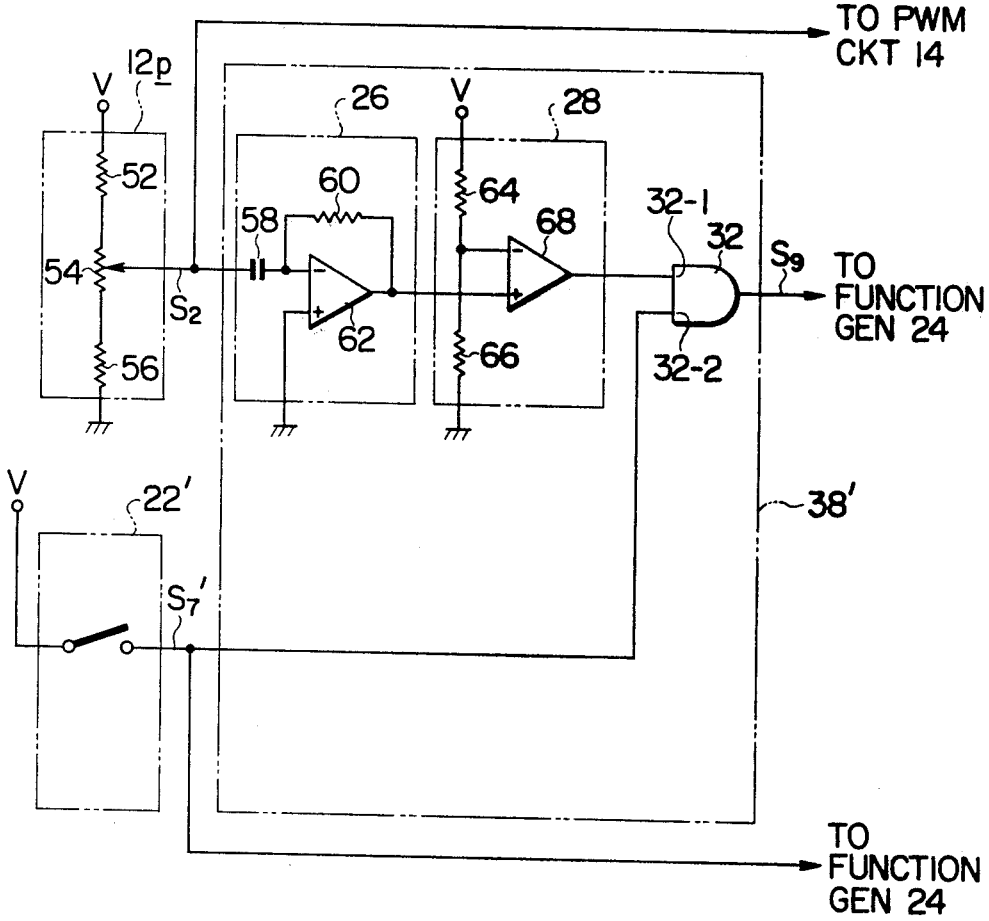
FIG. 7 shows a detailed circuit diagram of a fuel increase command signal generator used for a second preferred embodiment.

Hence, reference is now made to FIG. 7 which shows in a detailed circuit diagram the airflow meter 12, a throttle valve sensor 22', and a fuel increase command signal generator 38' utilized in a second embodiment of the fuel injection system according to the present invention. The circuit arrangement shown in FIG. 7 is the same as that of the first embodiment except that the potentiometer 70 utilized as the throttle valve sensor 22 is replaced with a switch 22' and the switch is directly connected to the second input 38-2 of the AND gate 32 while the second comparator 30 is omitted.

A movable contact of the switch 22' is operatively connected to the shaft of the throttle valve 48 shown in FIG. 2 and is connected to a terminal to which a predetermined voltage "V" (logic 1) is applied. The switch 22' is arranged to close (turn on) when the opening degree of the throttle valve 48 is falls below a predetermined value and thus a logic "1" signal is fed to the function generator 24 and to the second input 32-2 of the AND gate 32. It is to be noted that in the second embodiment means for comparing the output voltage of the throttle valve sensor 22' is unnecessary since the output signal $S'_7$ of switch 22' utilized as a throttle valve sensor is of a logic level and is applied to the AND gate 32 only when the opening degree of the throttle valve 48 is below a predetermined value.

Although in the above described first and second embodiments, the throttle valve sensor 22 or 22' is provided, in the form of either a potentiometer or of a switch, independently from the airflow meter 12, such means for detecting the opening degree of the throttle valve 48 may be omitted if the airflow meter output signal $S_2$ is utilized for detecting the condition in which the throttle valve is closed below a predetermined value.

Figure 8:
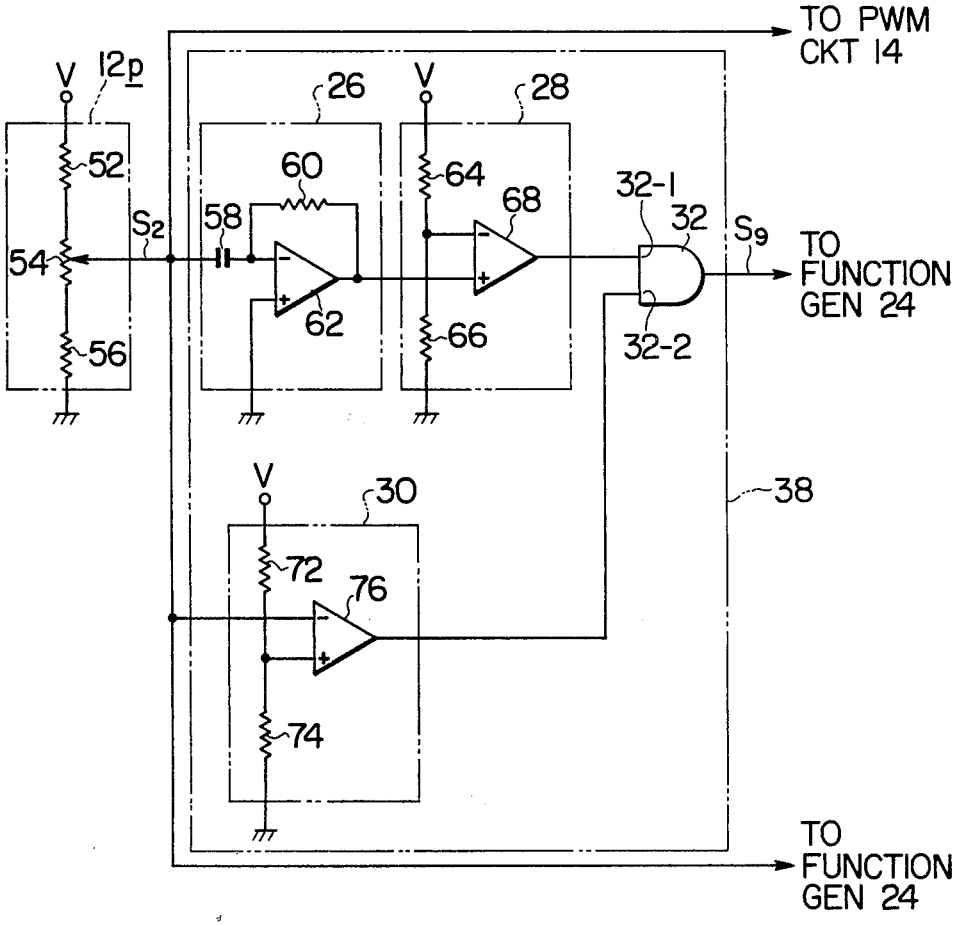
FIG. 8 shows a detailed circuit diagram of a fuel increase command signal generator used for a third preferred embodiment.

Hence, reference is now made to FIG. 8 which shows in a detailed circuit diagram of the potentiometer **12*b* included in the airflow meter 12 and the fuel increase command signal generator 38 used for a third preferred embodiment. The circuit arrangement shown in FIG. 8 has the same construction as that shown in FIG. 6 except that the throttle valve sensor 22 shown in FIG. 6 is omitted and the inverting input "−" of the operational amplifier 76 of the second comparator 30 is connected to the movable contact of the variable resistor 54 included in the airflow meter potentiometer 12*p*. Since the movable contact of the variable resistor 54 is directly connected to the second comparator 30, the second comparator 30 produces an output signal when the voltage at the movable contact of the variable resistor 54 falls below a predetermined voltage indicating that the airflow rate is below a predetermined value. Therefore, the output signal of the second comparator 30 can be utilized in the same manner as in the first embodiment shown in FIG. 6**.

In the above mentioned three embodiments shown in FIGS. 6, 7 and 8, the second input 32-2 of the AND gate 32 is arranged to receive a signal indicating that the opening degree of the throttle valve 48 is below a predetermined value or the airflow rate measured by the airflow meter 12 is below a predetermined value. This means that a signal applied to the second input 32-2 of the AND gate 32 should indicate that the engine is not undergoing acceleration. Therefore, other signals such as a signal indicative of the stroke of the acceleration pedal may be used instead.

Figure 9:
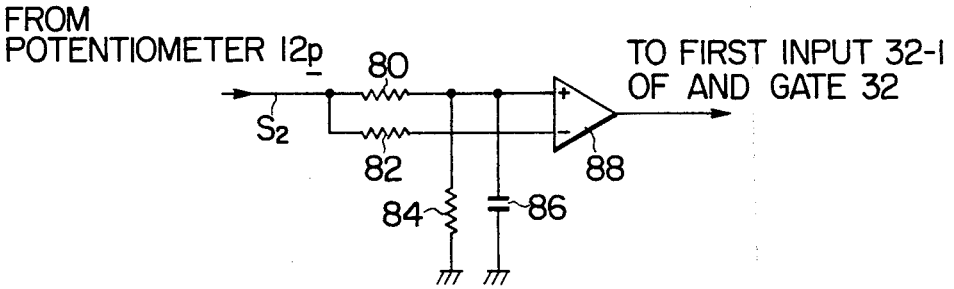
FIG. 9 shows a detailed circuit diagram of a circuit which may be utilized instead of the combination of the differentiator and the first comparator shown in FIGS. 6, 7 and 8.

FIG. 9 illustrates a circuit which may be used instead of the differentiator 26 and the first comparator 28 shown in FIGS. 6, 7 and 8. The circuit consists of an operational amplifier 88, first, second and third resistors 80, 82 and 84 and a capacitor 86. The first and the second resistors 80 and 82 are respectively interposed between the movable contact of the variable resistor 54 of the potentiometer **12*p* and a noninverting input "+" of the operational amplifier 88 and between the same movable contact and an inverting input "−" of the operational amplifier 88. The third resistor 84 and the capacitor 86 are connected in parallel and are interposed between the noninverting input "+" of the operational amplifier 88 and ground. The output of the operational amplifier 88 is connected to the first input 32-1 of the AND gate 32**.

The first resistor 80 and the capacitor 86 constitute an integrator so that the noninverting input "+" of the operational amplifier 88 is fed with a signal obtained by integrating the voltage at the movable contact of the variable resistor 54 with respect to time, while the inverting input "−" of the operational amplifier 88 is directly fed with the voltage at the movable contact via the second resistor 82. With this arrangement when the voltage of the signal $S_2$ derived from the potentiometer **12*p* drops, a voltage at the noninverting input "+" of the operational amplifier 88 becomes higher than that at the inverting input "−" of the same due to time lag of first order. The degree of the time lag is determined by the time constant of the integrator where the time constant is selected by selecting the resistance and capacitance of the first resistor 80 and the capacitor 86**.

The operational amplifer 88 is arranged to function as a comparator and is arranged to produce an output signal when the voltage difference between the inverting input "−" and the noninverting input "+" is over a predetermined value. Therefore, it will be understood that the operational amplifier 88 produces an output signal when the voltage of the signal $S_2$ drops with a rate (speed) over a predetermined value. Consequently, the circuit shown in FIG. 9 functions in the same manner as the combination of the differentiator 26 and the first comparator 28.

From the foregoing it will be understood that the fuel injection system according to the present invention provides various effects described in the SUMMARY OF THE INVENTION. It is further to be understood by those skilled in the art that the foregoing description is preferred embodiments of the disclosed invention and that various changes and modifications may be made in the invention without departing from the spirit and scope thereof.

What is claimed is:

1. A fuel injection system equipped with a fuel increase command signal generator, for an automotive internal combustion engine, including; means for measuring the airflow rate of the intake air of said engine; means for producing a first pulse signal in response to the ignition pulses of said engine; means for modifying the pulse width of said first pulse signal in accordance with the measured airflow rate for producing a second pulse signal; means for modifying the pulse width of said second pulse signal in accordance with engine parameters for producing a third pulse signal; means for driving fuel injection valves of said engine in accordance with said third pulse signal; means for producing a fuel increase command signal with which the fuel flow rate is increased for a short period of time for compensating for a lean air/fuel mixture supplied to said engine due to overshoot characteristics of said airflow meter; and a throttle valve wherein said means for producing the fuel increase command signal comprising:

(a) first means for detecting the decrease rate of the airflow rate;

(b) second means for detecting the condition of the throttle valve; and (c) gate means responsive to said first and second means for producing said fuel increase command signal only when the rate of decrease of the airflow is over a predetermined value while the opening degree of said throttle valve is below a predetermined value.

2. A fuel injection system as claimed in claim 1, wherein said first means comprises, a differentiator responsive to the output signal of a potentiometer included in said airflow meter, and a comparator responsive to the differentiator output signal for producing an output signal when the output voltage of said differentiator is over a predetermined value.

3. A fuel injection system as claimed in claim 1, wherein said first means comprises; an integrator responsive to the output signal of a potentiometer included in said airflow meter, and a comparator responsive to the output signal of said potentiometer and to the output signal of said integrator for producing an output signal when the output voltage of said integrator is over the voltage of said output signal of said potentiometer.

4. A fuel injection system as claimed in claim 1, wherein said second means comprises; a potentiometer operatively connected to the throttle valve of said engine for producing an output signal indicative of opening degree of the throttle valve, and a comparator responsive to the output signal of said potentiometer for producing an output signal when the voltage of said signal is over a predetermined value.

5. A fuel injection system as claimed in claim 1, wherein said second means comprises; a switch operatively connected to the throttle valve of said engine for producing a signal when the opening degree of the throttle valve is below a predetermined value.

6. A fuel injection system as claimed in claim 1, wherein said second means comprises; a comparator responsive to the output signal of a potentiometer include in said airflow meter for producing an output signal when the potentiometer output signal is below a predetermined value.

7. A fuel injection system as claimed in claim 1, wherein said gate means comprises; an AND gate the first and second inputs of which are respectively connected to the outputs of said first and second means.

* * * * *